US005570818A

United States Patent [19]

Strong

[11] Patent Number: 5,570,818

[45] Date of Patent: Nov. 5, 1996

[54] VALVE ASSEMBLY WITH SECURITY SEAL

[75] Inventor: Bernard Strong, Tarzana, Calif.

[73] Assignee: Propak-California Corp., City of Industry, Calif.

[21] Appl. No.: 445,390

[22] Filed: May 19, 1995

Related U.S. Application Data

[63] Continuation of Ser. No. 151,725, Nov. 12, 1993, Pat. No. 5,445,298.

[51] Int. Cl.[6] ..... B65D 47/28

[52] U.S. Cl. ..... 222/153.14; 222/523; 222/541.7; 156/69; 156/293; 156/308.4; 156/344

[58] Field of Search ..... 222/153.06, 522, 222/523, 541.7, 525, 153.14; 156/69, 290, 293, 294, 308.4, 309.6, 344; 29/521; 53/412, 133.2

[56] References Cited

U.S. PATENT DOCUMENTS

| | | | |
|---|---|---|---|
| 3,430,824 | 3/1969 | Conners et al. | 222/523 |
| 3,834,597 | 9/1974 | Guala | 222/525 |
| 4,408,700 | 10/1983 | Fillmore et al. | 222/525 |
| 4,478,242 | 10/1984 | Bond | 222/153.06 |
| 4,640,427 | 2/1987 | Marino et al. | 156/69 |
| 4,726,481 | 2/1988 | Hagan | 156/69 |
| 5,445,298 | 8/1995 | Strong | 222/153.14 |

*Primary Examiner*—Andres Kashnikow
*Assistant Examiner*—Philippe Derakshani
*Attorney, Agent, or Firm*—Lyon & Lyon

[57] ABSTRACT

A liquid dispensing assembly and method of construction for a push-pull type valve having a sealing mechanism which resists undesirable dislodgement or leakage such as encountered during transport. The push-pull valve for a container or bottle is equipped with a security seal or connection plug formed between the inner stem and the outer sleeve which preventing any relative movement between the inner and the outer sleeve during transport, is easily fracturable through deliberate actuation by the user rotating the inner stem.

18 Claims, 2 Drawing Sheets

VALVE ASSEMBLY WITH SECURITY SEAL

This is a continuation of application Ser. No. 08/151,725 filed on Nov. 12, 1993 now U.S. Pat. No. 5,445,298.

BACKGROUND OF THE INVENTION

The field of the present invention is liquid dispensing valves, taps and containers and more particularly is directed to a liquid dispensing valve for use in drawing off liquid from the bottom of a container, the valve including a security seal.

A typical container for use with a valve according to the present invention is a plastic molded bottle such as disclosed in U.S. Pat. No. 3,430,824. The container is typically made by a blow molded polyethylene process and comes in various shapes and sizes. In such a container, an outlet neck is located at the bottom of the container so that liquid may proceed by gravity flow into a receiving receptacle. Since the dispensing assembly is located at the bottom and a breather hole is provided on the top of the container, the assembly is constantly subjected to liquid pressure. Normally the container is first filled with liquid and the dispensing assembly is then installed on the container which is then filled and shipped to its destination.

During shipment, the dispensing assembly must remain virtually leakproof. The valve assembly must maintain its leakproof integrity even when it is subjected to agitation, impact and the like encountered during transport. It is therefore desirable to ensure that leakproof integrity of the dispensing assembly is maintained during transportation.

SUMMARY OF THE INVENTION

The present invention is directed to a liquid dispensing assembly and method of construction for a dispensing assembly with a superior sealing mechanism which resists undesirable dislodgement or leakage such as encountered during transport. In a preferred embodiment of the present invention, a standard push-pull valve for a container or bottle is equipped with a security seal or connection plug formed between the inner stem and the outer sleeve which prevents relative movement between the inner stem and the outer sleeve during transport but which is fracturable through actuation by the user.

BRIEF DESCRIPTIONS OF THE DRAWINGS

DETAILED DESCRIPTION OF THE PREFERRED EMBODIMENTS

The preferred embodiment will now be described with reference to the drawings. For convenience, any numeral used to identify an element in one figure will represent the same element in any other figure.

Figure 1:
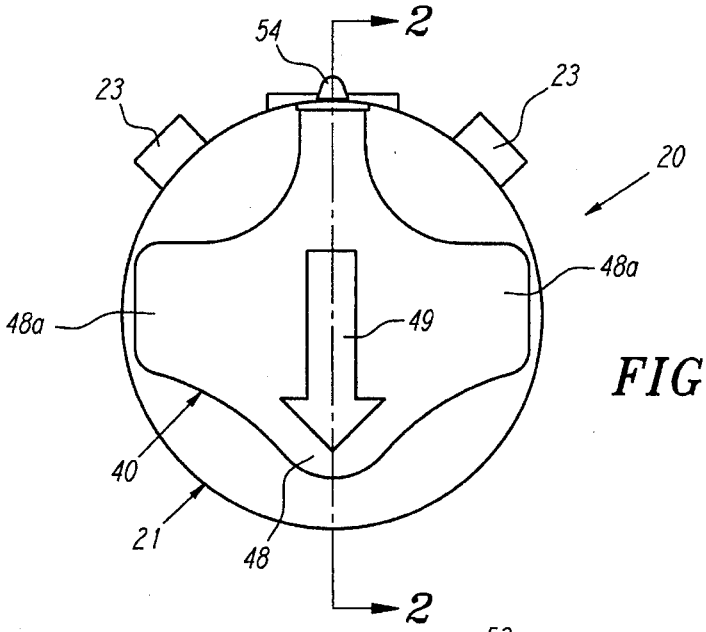
FIG. 1 illustrates a front view of a liquid container outlet neck and valve assembly according to the present invention.
Figure 2:
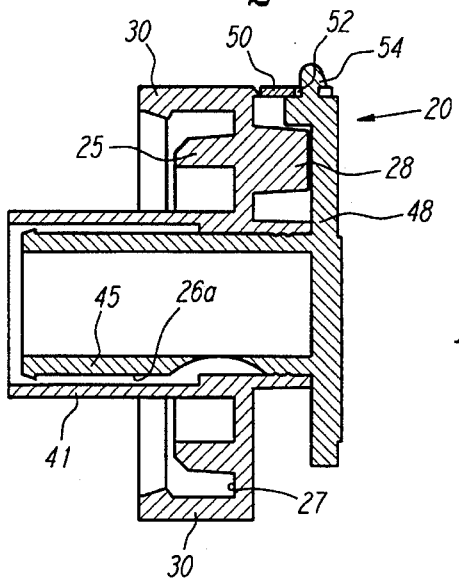
FIG. 2 is a cross section view of the outlet neck and valve assembly of FIG. 1 taken along line 2—2.
Figure 3:
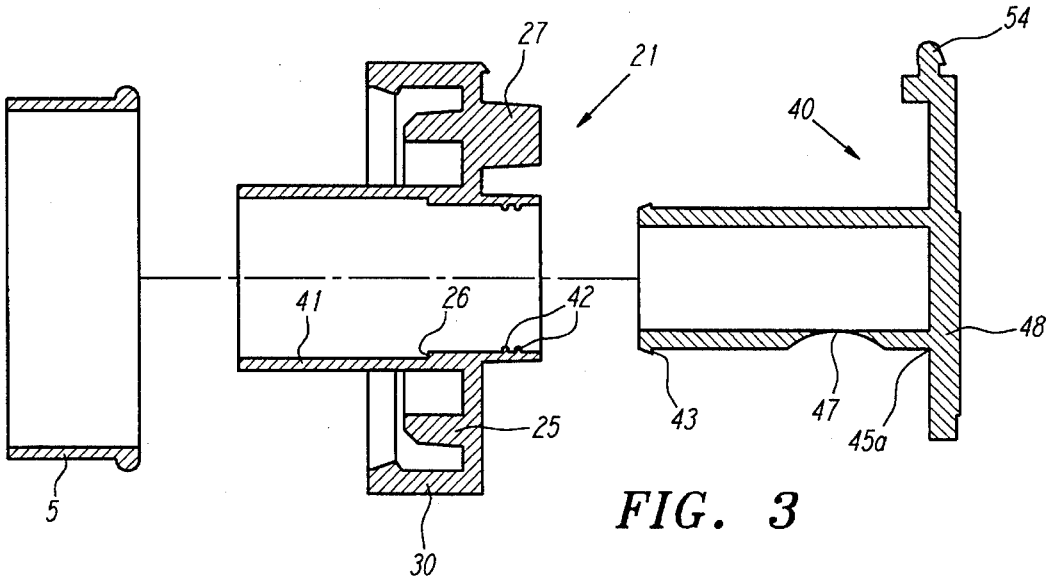
FIG. 3 is an exploded view of the valve assembly of FIG. 2.

FIGS. 1–6 illustrate a liquid container 1 upon which the push-pull type valve 20 is attached to an outlet neck 5 thereof (see FIG. 3). The dispensing valve 20 includes spigot portion 40 and valve body 21. The valve body 21 has an inner flange 25 and an outer flange 30 preferable formed in a molded integral one-piece construction. The inner flange 25 and outer flange 30 are cylindrically shaped and extend axially rearward from the valve body 21. The outlet neck 5 is inserted in the annular space between the inner flange 25 and the outer flange 30. The valve body 21 also includes ears 23 which assist in alignment of the dispenser valve 20 for automatic assembly onto the bottle neck 5.

The spigot portion 40 is sealably and slidably inserted into the valve portion body 21. The spigot portion 40 is comprised of a tubular stem 45 and a handle 48. The stem 45 is a hollow tube open on the container end and sealed on the end near the handle 48. In a preferred construction, the stem 45 and the handle 48 are formed in one-piece molded plastic. The stem 45 has a hole 47 which is sealed within the valve sleeve 41 when the stem 45 is inserted into the sleeve 41. As the stem 45 is pulled out from the sleeve 41 the inner stem 45 being concentrically positioned within the outer sleeve 41, liquid may flow out of the hole 47 when the hole 47 passes sleeve lip 42. The stem 45 includes a lip 43 which contacts an inner annular shoulder 26 within the sleeve 41 to halt the outward travel of the stem 45. When the valve is in the closed position as shown in FIG. 2, an annular space **26*a* is formed adjacent the annular shoulder 26 between the inner stem 45 and the outer sleeve 41**.

The valve 20 is equipped with a tampering evident mechanism. The mechanism may be a breakaway tab 50 installed between the handle 48 in the valve body 21 such as at outer flange 30. The tab 50 has a hole 52 therein into which knob 54 on handle 48 is inserted and said knob 54 is then heat sealed to said tab 50. The handle 48 may be equipped with an arrow configuration 49 to indicate the location of the hole 47 on the stem 45 (see FIG. 1).

The valve body 21 is also equipped with a keying mechanism such that when the valve 20 is installed on the outlet neck 5, the valve 20 does not rotate. The keying mechanism is comprised of a key member **30*a* which is a located in a corresponding slot in the collar of the outlet neck 5. The keying mechanism prevents rotation of the valve 20 relative to the outlet neck 5 when the valve 20** is installed thereon.

Since the valve 20 cannot rotate due to the keying mechanism, the handle 48 cannot be rotated or pulled without breaking the breaking tab 50. The valve 20 would then be originally installed with its arrow 49 on the handle 48 (which indicates the position of the hole 47) pointing to one side as opposed to downward as in FIG. 1. Then, to direct flow of liquid downward, the handle 48 would be rotated, breaking the tab 50.

The tab 50 may also be broken merely by being pulled outward on the sides of the handle 48. Though the tab 50 when fractured provides evidence of opening or tampering, it may not, however, provide sufficient security for preventing dislodgement of the spigot 40 from the valve body 21 during transport. To ensure integrity of the connection, a safety seal 60 is installed between the sleeve 41 and the stem 45 bridging the annular space 269 (see FIGS. 4–6). A connector plug 62 is formed therebetween by inserting a heated rod 65 externally and radially inward through the sleeve 41 and into the stem 45. The rod 65 is 4.0 millimeters in diameter and is heated to about 500° F. (260° C.). The rod 65 is inserted into position and held there for approximately one second so that the plug 62 is formed by melting the plastics in the sleeve 41 and the stem 45 together.

Figure 4:
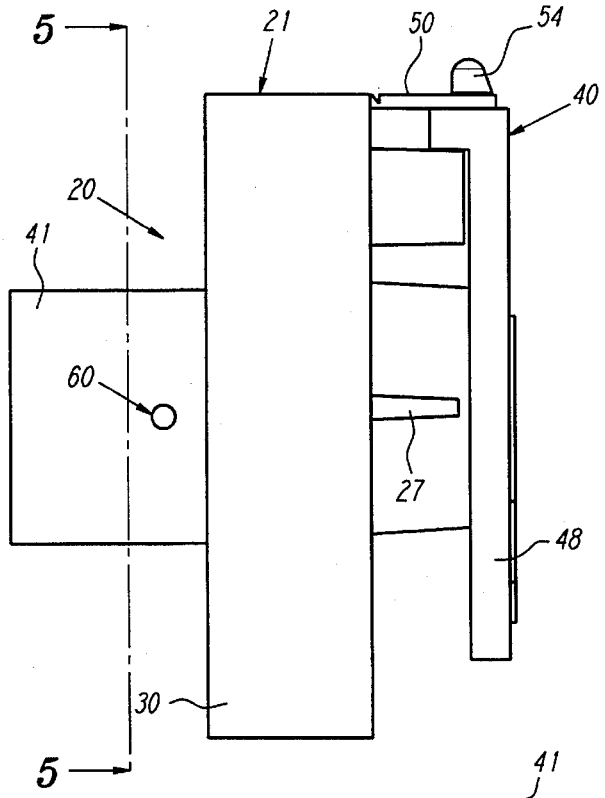
FIG. 4 is a right side elevation view of the valve assembly of FIG. 1.
Figure 6:
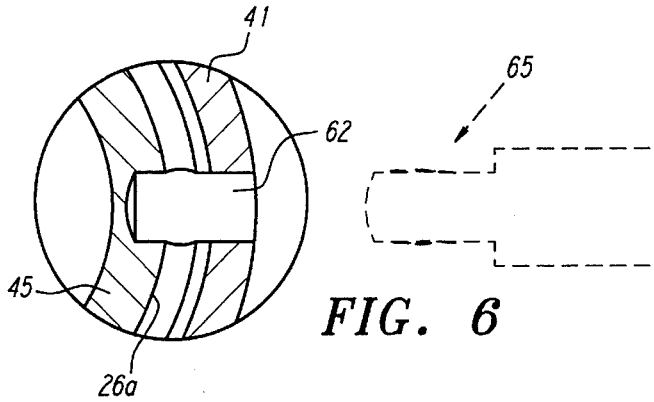
FIG. 6 is an enlarged view of the portion of FIG. 5.
Figure 5:
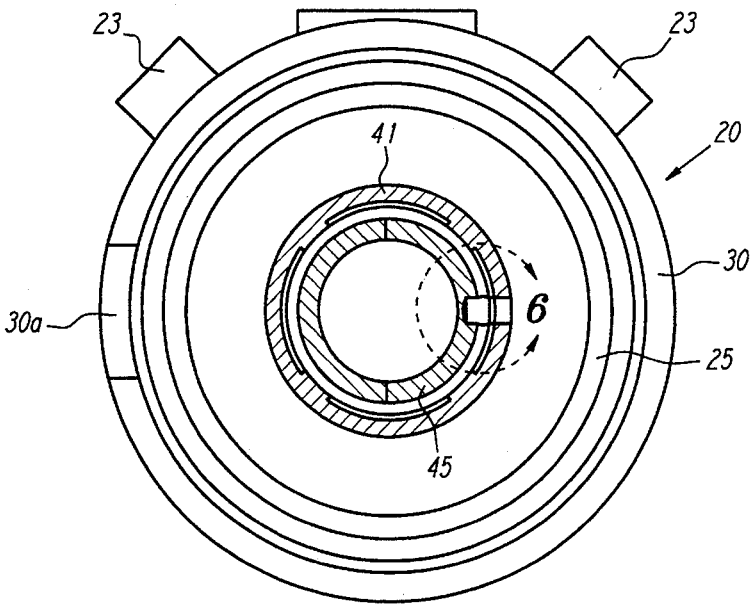
FIG. 5 is a cross sectional view of FIG. 4 taken along line 5—5.

Once the plug 62 is in place, the stem 45 is secured to the sleeve 41 to thus prevent any unwanted motion between the two components which could cause leakage. While the tab 50 may be removed by grasping and pulling outward on the handle 48, the plug 62 is formed with sufficient strength to inhibit outward movement of the stem 45 opening of the valve 20 merely by pulling on the handle 48. The lateral ears 48*a*, 48*a* of the handle 48 will bend slightly making it unlikely that the plug 62 will separate merely by pulling on the handle 48. However, a simple twisting or rotational motion of the handle 48 will apply a strong torque on the plug 62, fracturing or severing the plug 62 and allowing the stem 45 to be readily pulled forward to the open position. The connection prevents unwanted movement of the inner stem 45 relative to the outer sleeve 41 for precluding valve leakage during transport. The user activates the valve 20 by using mechanical advantage to rotate the inner stem 45 relative to the outer sleeve 41 to sever the connection between the outer sleeve 41 and the inner stem 45. The valve body 21 is also equipped with tabs 27 positioned behind the ears 48*a*, 48*a* and a tab 28 positioned below the knob 54 to provide support for the handle 48 when the spigot portion 40 is in the closed position (as shown in FIGS. 2 and 4).

Thus, a liquid dispensing assembly and method of construction for a dispensing assembly with superior sealing mechanism which precludes undesirable dislodgement or leakage such as encountered during transport have been shown and described. Though certain examples and advantages have been disclosed, further advantages and modifications may become obvious to one skilled in the art from the disclosures herein and the invention is not to be limited thereby except in the spirit of the claims that follow.

I claim:

1. A dispensing apparatus for a container comprising a push-pull type valve having an outer sleeve and an axially moveable inner stem concentrically positioned therein forming an annular space therebetween;

a connector plug radially positioned between the outer sleeve and the inner stem for resisting relative axial movement therebetween;

wherein the outer sleeve and the inner stem are constructed from molded plastic and the connector plug comprises a plastic melted connection formed in the annular space between the outer sleeve and the inner stem.

2. A dispensing apparatus according to claim 1 wherein the connector plug provides sufficient resistance to axial movement between the inner stem and the outer sleeve to prevent unintentional axial movement during transport of the dispensing apparatus.

3. A dispensing apparatus according to claim 1 wherein the connector plug is severable by rotation of the inner stem relative to the outer sleeve.

4. A dispensing apparatus according to claim 3 further comprising a handle portion attached to the inner stem wherein the connector plug is severable by grasping the handle and rotating the inner stem relative to the outer sleeve.

5. A dispensing apparatus according to claim 1 wherein the connector plug is formed by inserting a heated rod externally through the outer sleeve and into the inner stem for melting a portion of the outer sleeve and the inner stem together.

6. A method of making a push-pull type dispensing valve comprising the steps of positioning an inner stem concentrically within an outer sleeve and forming an annular space therebetween;

forming a fracturable connection plug in the annular space between the inner sleeve to the outer sleeve by inserting a heated rod externally through the outer sleeve and into the inner stem for melting a portion of plastic in the outer sleeve and the inner stem together.

7. A method of making a push-pull type dispensing valve comprising the steps of positioning an inner stem concentrically within an outer sleeve and forming an annular space therebetween;

forming a connection plug in the annular space between the inner sleeve to the outer sleeve by inserting a heated rod externally through the outer sleeve and into the inner stem for melting a portion of plastic in the outer sleeve and the inner stem together, wherein the connection plug between the inner sleeve and the outer sleeve is severable by rotating the inner stem relative to the outer sleeve.

8. A method of making a push-pull type dispensing valve for installation on a neck of a bottle, comprising the steps of molding valve components including (a) an inner stem and (b) an outer sleeve with a flange section which is attachable to the neck of the bottle;

assembling the valve by positioning the inner stem concentrically within the outer sleeve;

forming a connection between the inner stem and the outer sleeve at a position to one side of the flange section such that the connection is positioned within the neck of the bottle when the valve is installed on the neck of the bottle.

9. A method according to claim 8 wherein the connection between the inner sleeve and the outer sleeve is severable by rotating the inner stem relative to the outer sleeve.

10. A method of making a push-pull type dispensing valve for installation on a neck of a bottle, comprising the steps of providing the valve with a flange section which is attachable to the neck of the bottle;

assembling the valve by positioning an inner stem concentrically within an outer sleeve;

forming a connection between the inner stem and the outer sleeve at an axial position to one side of the flange section, wherein the step of forming a connection comprises inserting a heated rod externally through the outer sleeve and into the inner stem for melting a portion of the outer sleeve and the inner stem together.

11. A method of making a push-pull type dispensing valve for installation on a neck of a bottle, comprising the steps of providing the valve with a flange section which is attachable to the neck of the bottle;

assembling the valve by positioning an inner stem concentrically within an outer sleeve;

forming a connection between the inner stem and the outer sleeve at an axial position to one side of the flange sections wherein the step of forming a connection comprises melting a portion of plastic in the outer sleeve and the inner stem together with a heated rod.

12. A method of making a push-pull type dispensing valve for installation on a neck of a bottle, comprising the steps of providing the valve with a flange section which is attachable to the neck of the bottle;

assembling the valve by positioning an inner stem concentrically within an outer sleeve;

forming a connection between the inner stem and the outer sleeve at an axial position to one side of the flange section;

installing the valve on the neck of the bottle and thereby enclosing the connection within the neck of the bottle.

13. A dispensing apparatus for a container comprising a push-pull type valve having an outer sleeve, an axially moveable inner stem concentrically positioned in the outer sleeve, and a flange section which is attachable to a neck of the container; and a connector plug radially positioned between the outer sleeve and the inner stem for resisting relative axial movement therebetween, the connector plug being located to one side of the flange section such that the connector plug is disposed within the neck of the container when the valve is installed on the neck of the container.

14. A dispensing apparatus according to claim 13 wherein the connector plug provides sufficient resistance to axial movement between the inner stem and the outer sleeve to prevent unintentional axial movement during transport of the dispensing apparatus.

15. A dispensing apparatus according to claim 13 wherein the connector plug is severable by rotation of the inner stem relative to the outer sleeve.

16. A dispensing apparatus according to claim 13 further comprising a handle portion attached to the inner stem wherein the connector plug is severable by grasping the handle and rotating the inner stem relative to the outer sleeve.

17. A dispensing apparatus for a container comprising a push-pull type valve having an outer sleeve, an axially moveable inner stem concentrically positioned in the outer sleeve, and a flange section which is attachable to a neck of the container; and a connector plug radially positioned between the outer sleeve and the inner stem for resisting relative axial movement therebetween, wherein the outer sleeve and the inner stem are constructed from molded plastic and the connector plug comprises a plastic melted connection formed therebetween.

18. A dispensing apparatus for a container comprising a push-pull type valve having an outer sleeve, an axially moveable inner stem concentrically positioned in the outer sleeve, and a flange section which is attachable to a neck of the container; and a connector plug radially positioned between the outer sleeve and the inner stem for resisting relative axial movement therebetween, wherein the connector plug is formed by inserting a heated rod externally through the outer sleeve and into the inner stem for melting a portion of plastics in the outer sleeve and the inner stem together.

* * * * *